US007450028B2

(12) United States Patent
De Godzinsky

(10) Patent No.: US 7,450,028 B2
(45) Date of Patent: Nov. 11, 2008

(54) LED OPERATION LIGHT

(75) Inventor: Christian De Godzinsky, Vantaa (FI)

(73) Assignee: Planmeca Oy, Helsinki (FI)

( * ) Notice: Subject to any disclaimer, the term of this patent is extended or adjusted under 35 U.S.C. 154(b) by 152 days.

(21) Appl. No.: 10/561,203

(22) PCT Filed: Jun. 28, 2004

(86) PCT No.: PCT/FI2004/000395

§ 371 (c)(1),
(2), (4) Date: May 5, 2006

(87) PCT Pub. No.: WO2005/006818

PCT Pub. Date: Jan. 20, 2005

(65) Prior Publication Data

US 2006/0239005 A1 Oct. 26, 2006

(30) Foreign Application Priority Data

Jun. 27, 2003 (FI) ..... 20030959

(51) Int. Cl.
*G09F 9/33* (2006.01)

(52) U.S. Cl. ..... 340/815.45; 340/815.65; 362/105; 362/276; 362/555; 362/572; 362/800

(58) Field of Classification Search ..... 340/815.45, 340/815.53, 815.65, 815.56, 815.6, 815.66, 340/815.67; 362/555, 572 X, 800, 231, 105 X, 362/105, 573, 276 X, 802, 295; 250/201.1, 250/228, 226; 361/782; 315/76, 169.3, 316
See application file for complete search history.

(56) References Cited

U.S. PATENT DOCUMENTS

| | | | | |
|---|---|---|---|---|
| 5,634,711 | A * | 6/1997 | Kennedy et al. | 362/119 |
| 6,183,086 | B1 | 2/2001 | Neubert | |
| 6,411,046 | B1 * | 6/2002 | Muthu | 315/309 |
| 6,459,919 | B1 | 10/2002 | Lys et al. | |
| 7,148,632 | B2 * | 12/2006 | Berman et al. | 315/189 |
| 7,157,694 | B2 * | 1/2007 | May et al. | 250/228 |
| 7,235,766 | B2 * | 6/2007 | Shur et al. | 250/205 |
| 7,255,457 | B2 * | 8/2007 | Ducharme et al. | 362/231 |
| 2001/0036219 | A1 * | 11/2001 | Camm et al. | 374/112 |
| 2003/0072147 | A1 | 4/2003 | Pashley et al. | 362/92 |
| 2003/0107887 | A1 | 6/2003 | Eberl | 362/227 |

FOREIGN PATENT DOCUMENTS

| | | |
|---|---|---|
| WO | WO 02/06723 A1 | 1/2002 |
| WO | 2004025998 | 3/2004 |
| WO | 2004060024 | 7/2004 |

* cited by examiner

*Primary Examiner*—Brent Swarthout
(74) *Attorney, Agent, or Firm*—WolfBlock LLP

(57) ABSTRACT

A LED operation light, comprising at least two power sources, at least one of which is an adjustable power source, at least two LED units, and measuring and control means. The LED units, which comprise one or more LED components, emit light in response to power received from the power source. The LED components have been arranged to produce emission of light color components of at least two different wavelengths. The measuring means have been arranged to measure light emission of the LED unit and, based on measurement data, to generate control information to be sent to the adjustable power source to adjust the magnitude of power to be supplied to the LED unit. The light emission of the LED component changes as the received power changes, which again results in a change in the correlation between the emitted light color components, and therefore in the color temperature.

22 Claims, 5 Drawing Sheets

LED OPERATION LIGHT

FIELD OF THE INVENTION

The present invention relates to operation lights and in particular to LED (Light Emitting Diode) operation lights.

BACKGROUND OF THE INVENTION

In medical treatment, such as dental treatment, operations requiring high precision are carried out where human errors may be harmful or even dangerous to a patient. In this respect, a standard general illumination system is not necessarily an optimal solution to enable precision work, but the area to be operated on, such as an oral cavity, is typically illuminated using separate operation lights. The operation light may be arranged to be adapted for use in connection with a particular operation or diagnosis and/or to have some functions adjustable e.g. on patient-specific basis. The light produced by the operation light must also be bright enough in order to allow for the operation to be carried out safely and effectively. However, the light must not be too bright so that it would dazzle the person performing the operation or the patient. Also, the general illumination of the operating environment has to be so implemented that no excessive contrast will be created between the area to be operated on and the operating environment.

In prior-art operation lights the light sources used include halogen bulbs and LED components. However, none of the manufacturers in the dental industry have yet brought any LED-based operation lights to the market. A problem with lights based on halogen bulbs is that they warm up intensively and may thus cause burns. In addition, halogen bulbs always involve a risk of explosion. This type of lights are also available provided with a fan, but typically the fan makes the light noisy, complicated in structure and unhygienic. A further problem with halogen bulb based lights is the relatively short life time of the bulbs, which involves extra service costs. Further, if brightness of a halogen bulb light is adjusted e.g. during an operation, this may have an undesirable consequence of change of color temperature as well. The holders (sockets) typically used with halogen bulbs heat up as well, which makes them unreliable components.

LED lights can be constructed to be fairly compact and light. Also, they require no mechanical components subject to wear, such as noisy fans. In addition, the electronics of a LED light can be arranged to be relatively simple and therefore inexpensive. It is also possible to provide LED components with an integrated reflector, in which case many light applications will not need a separate reflector or lens for directing light at all. Besides, the use of such lenses may produce a so-called rainbow effect at the edge of the light beam directed at the area to be operated on.

In general, a LED light only produces so-called cold light, because infrared radiation, i.e. radiation that generates heat, is typically very slight in the direction of the beam produced.

The maintenance costs of a LED light are also relatively small since the theoretical life time of LED components in continuous use is very long, even over 100 000 hours. Moreover, the LED light involves no risk of explosion, so it can be constructed without an explosion shield or other protective structures. As convectional cooling alone is sufficient, there is also no need for separate ventilation holes, which are unhygienic and get dirty.

Structurally, a LED component is a semiconductor junction and it is typically manufactured from gallium arsenide (GaAs), gallium arsenide phosphide (GaAsP), gallium phosphide (GaP) or some other corresponding material. The LED component is generally connected in the forward direction, because if connected in the reverse direction it will not produce any light and may even be damaged. The LED component is preferably fed by a supply voltage, which is equal to its threshold voltage, i.e. typically a voltage of about 1.1-3.8 V. If the LED component is fed by a voltage substantially higher than the threshold voltage, the supply voltage exceeding the threshold voltage is preferably passed e.g. to a series resistor in order to prevent damage to the LED component. The connecting lines of the LED component are the same as in an ordinary diode, i.e. anode and cathode.

Typically the operation of a LED component is based on charge carriers, i.e. electrons and holes, which move across a semiconductor junction, due to the effect of forward current, and emit photons upon recombination, i.e. upon being united again, which appears as emitted light. The color of the light emitted in the light emission process depends on the semiconductors forming the junction and the doping used in them. For example, gallium phosphide (GaP) doped with zinc (Zn) and oxygen (O) generally produces red light.

Typical standard LED components include red, yellow and greed LED components. Today, standard LED components are generally available in two sizes; in round packages of 3 and 5 mm in diameter. In addition, there are e.g. orange LED components whose packaging typically corresponds packaging of the standard LED components, and so-called transparent LED components, which have a clear package but the color of light is typically red, green or yellow, depending on the semiconductors of the component, or on the doping used in them.

An RGB LED component typically comprises, as indicated by its name, a Red, a Green and a Blue LED component. By means of an RGB LED component it is possible to produce any of these colors of the LED components and mixtures thereof, in fact any color within the color spectrum in question. The mixing of colors is typically accomplished by directing the light beams produced by the LED components to the same spot. In this case, however, it is necessary to take into account that different wavelengths undergo different refractions. For instance, blue light is refracted considerably more than red light.

There are also available e.g. LED components emitting white light. One possibility of implementing a LED component emitting white light is to integrate red, green and blue LED components with each other. However, in this case there is the problem that it is difficult to maintain a constant color temperature, because color temperatures of the LED components manufactured from different material mixtures change in different ways according to the temperature, the power supplied and the age of the component. Another possibility is to provide the LED component with fluorescing material absorbing the wavelength of the LED component used, and emitting a wavelength or wavelengths longer than absorbed, which fluorescing material may consist of e.g. different phosphors or phosphor layers. The LED component may also be composed of an ultraviolet LED component and phosphor. From the sum and combined effect of the different wavelengths produced it is possible to generate light of a substantially different color, e.g. white.

However, even white LED components exhibit a relatively wide variation of color temperature. For example, for a nominal color temperature of 5500K the variation of color temperature may be in the range of 4400-8000 K. This variation depends especially on the thickness of the phosphor layer deposited on the LED components during manufacture. To normalize the color temperature white LED components generally have to be measured to make it possible to select the ones having color temperature of e.g. about 5500 K. However, the variation of color temperature of white LED components means that even lights composed of several white LED components contain, precisely speaking, LED components emitting different colors.

Publication U.S. Pat. No. 6,459,919 discloses a general-purpose LED operation light and publication WO 02/06723 discloses a LED operation light applicable for dental use. The LED operation light described in WO 02/06723 publication generates a light field having a predetermined size, illumination intensity, uniformity of illuminance and color temperature. The first and second light fields consist of light beams generated by several LED components placed close to each other so that the second light field at least partially covers the first light field. According to the publication, brightness of the light field produced by the light can be influenced by implementing alignment of the individual light beams produced by the LED components arranged to it different, and the illumination intensity influenced by varying the number of LED components connected.

Thus, a typical problem with prior-art operation lights is that color temperature of the light produced by them does not remain essentially constant or as adjusted. If brightness of a halogen bulb light is adjusted during an operation, the color temperature of the light produced by it will change. On the other hand, the color temperature of LED operation lights may change e.g. with aging of the LED components producing different colors, because the mutual relations between the color components change as the light emissions produced by the LED components decay in different proportions. Color temperature here refers to the mutual ratio between the color components produced by the operation light. The color temperature of an operation light is typically adjusted to about 5000-6000 K, which corresponds to the luminosity of a cloudy midday.

In some operations it may also be advantageous to have a possibility to use a color temperature other than only a given predetermined color temperature. In prior-art operation lights there is no possibility to keep the color temperature within desired limits nor to adjust the color temperature as desired according to the needs of an individual operation on one hand, and so that it could be kept at a desired or constant setting throughout the life time of the LED operation light on the other.

BRIEF DESCRIPTION OF THE INVENTION

The object of the invention is therefore to develop a LED operation light that makes it possible to reduce the above-mentioned problems. The object of the invention is achieved by a LED operation light and a method characterized by what is said in the independent claims. The preferred embodiments of the invention are subjects of the dependent claims.

The basic idea of the invention is that a LED operation light comprises LED components emitting at least two different wavelengths and means for adjusting at least the LED components emitting one wavelength. Preferably and in more general terms, the LED operation light comprises LED components emitting at least N different colors, where N=2 or a greater integer, and means for adjusting the emission of at least N−1 of these. Preferably the emission of all different color components can be adjusted. The light according to the invention thus has e.g. at least two power sources, at least one of which is a variable power source, and at least two LED components emitting different colors and at least one measuring and control means. The power sources supply power to the LED components, which emit light in response to the power received from the power sources.

Thus, according to the invention, the LED components have been arranged to produce color components of the light emission of the LED operation light at two different wavelengths at least. The measuring means, such as a measuring sensor, has been arranged to measure, e.g. periodically, such magnitudes produced by the LED components the correlation of which to the color temperature produced by the light is known, such as the intensity of each color component or the temperature of the LED components. Control means, such as a processor or logic circuit, has been arranged to generate control information based on the measurement data, such as a measurement signal, to be sent to at least one adjusting means, such as an adjustable power source, e.g. as an adjustment signal, for adjusting the production of at least one color component and thus for controlling the color temperature of the light produced by the entire LED operation light.

According to a preferred embodiment, a LED component unit comprises a red, a green and a blue LED component.

According to a preferred embodiment, the LED component unit comprises at least one white LED component or it consists exclusively of white LED components.

According to a preferred embodiment, the LED components comprised in a LED component unit are so disposed that they form at least one row consisting of at least two LED components, and the LED component unit comprises a collimator aligned with this row.

According to a preferred embodiment, at least some, preferably all of the LED components of same color are connected functionally in parallel and electrically preferably in series.

According to a preferred embodiment, the LED operation light comprises, for the LED components emitting at least one color component, a structure in which an adjustable power source is integrated with each LED component.

According to a preferred embodiment, the LED component is a high power LED component whose average input power is greater than 500 mW.

According to a preferred embodiment, one of the power sources is a constant-current source.

According to a preferred embodiment, the power to be supplied to the LED components has been arranged to be adjustable via pulse-width modulation.

According to a preferred embodiment, the LED operation light comprises a light part with a maximum of five LED component units functionally connected to it.

According to a preferred embodiment, at least one of the LED component units comprises at least one collimator.

According to a preferred embodiment, the angle between the central rays of the light beams emitted by the outermost LED component units is at least 5 degrees.

An essential advantage provided by the arrangement according to the invention is that color temperature of the LED operation light can be maintained within desired limits, e.g. at 5000-6000 K, throughout the life time of the LED components, and that brightness of the light of the operation light can be adjusted essentially without changing the color temperature. A further advantage is that when LED components of different colors and/or emitting different shades of white are used, it is possible to create new functionalities, such as production of desired spectral distributions. For example, in repairing a tooth it is important that the filling composite does not harden too soon, so in lights according to a preferred embodiment of the invention the light emission of wavelengths such as that of blue light, which harden the filling composite can be minimized for the duration of handling of the composite by adjusting the emission of the LED component or components producing the wavelength in question.

BRIEF DESCRIPTION OF THE FIGURES

The invention will now be described in more detail in connection with preferred embodiments and with reference to the attached drawings, wherein.

DETAILED DESCRIPTION OF THE INVENTION

Figure 1:
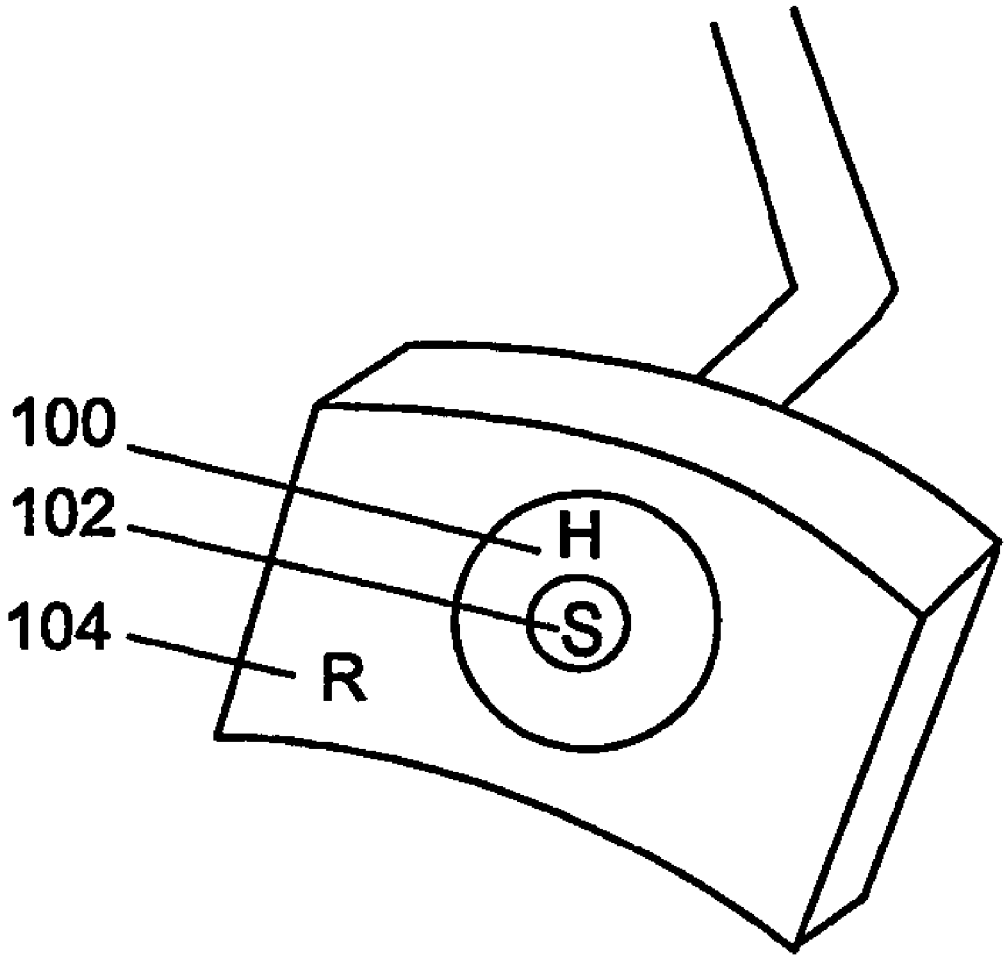
FIG. 1 presents a typical prior-art operation light used in dental operations.

FIG. 1 presents a halogen-bulb based operation light typically used in dental operations, which comprises a light producing halogen bulb H (100), a glare shield S (102) and a reflector part R (104) reflecting light.

Figure 2A:
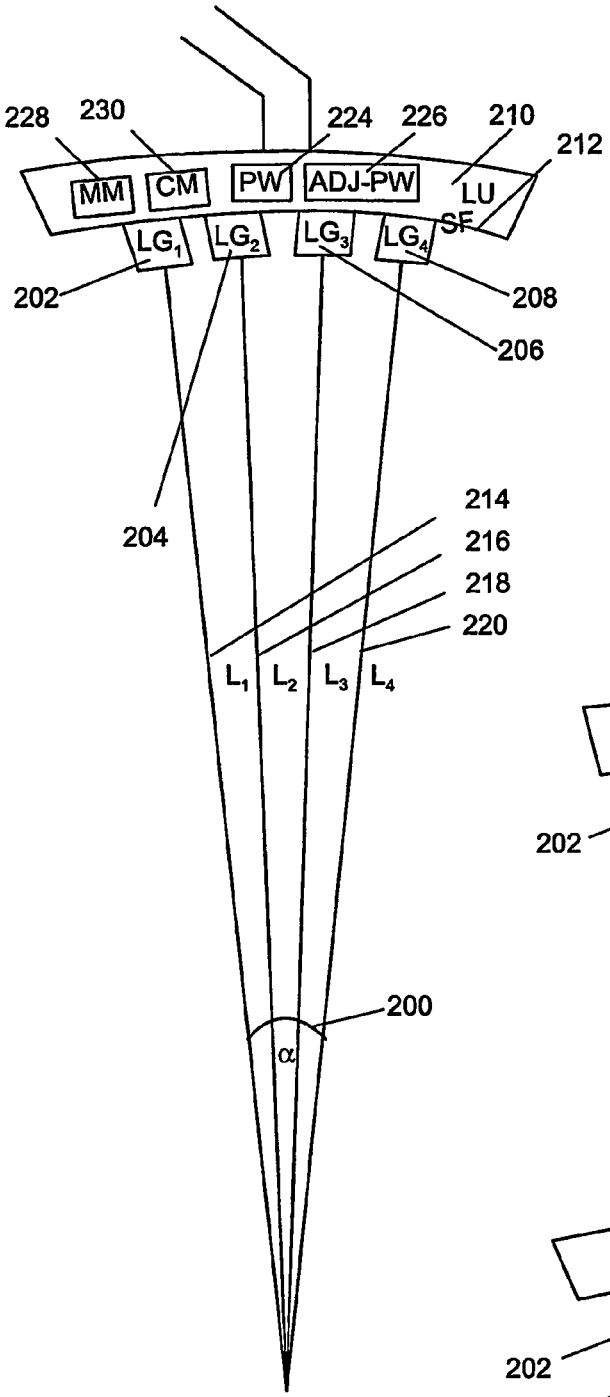
FIGS. 2*a*, 2*b* and 2*c* illustrate structures of light parts of LED operation lights according to certain preferred embodiments of the invention.
Figure 2B:
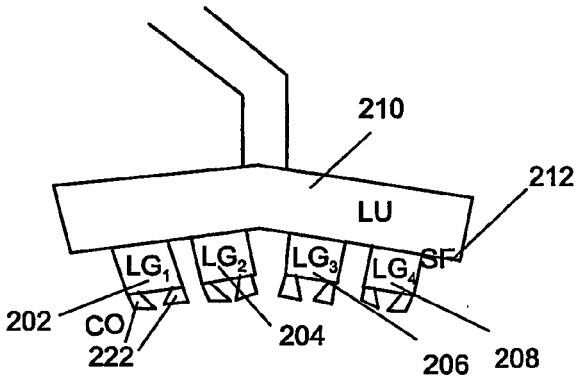
Figure 2C:
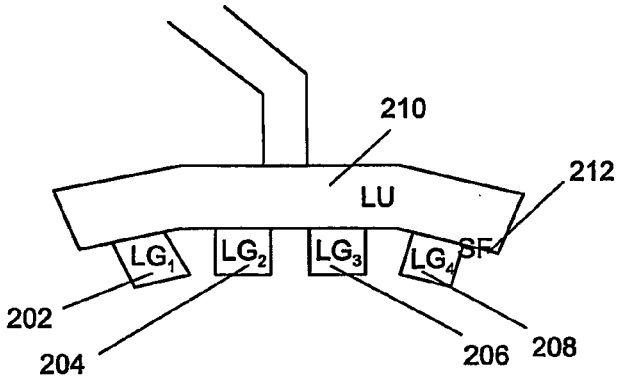

FIGS. 2*a*, 2*b* and 2*c* present structures of light parts of LED operation lights according to certain preferred embodiments of the invention, using uniform reference numbering.

In dental care, a typical distance of the operation light from the area to be operated on is about 50-80 cm. To ensure that obstructions, such as hand or head of the person performing the operation that may come between the light source and the area under operation would not darken the entire light beam too easily, the LED component units should be arranged such that the angle α (200) between the central rays of the light beams emitted by the outermost LED component units $LG_1$ (202), $LG_4$ (208) is at least 5 degrees.

The LED operation light according to FIG. 2*a* comprises four LED component units $LG_1$ (202), $LG_2$ (204), $LG_3$ (206), $LG_4$ (208), which have been arranged to emit light in response to power received from power sources PW (224), ADJ-PW (226). The LED component units $LG_1$ (202), $LG_2$ (204), $LG_3$ (206), $LG_4$ (208) comprise one or more LED components, which have been arranged to produce color components of light emission of the LED operation light at two different wavelengths at least. Thus, the LED component units $LG_1$ (202), $LG_2$ (204), $LG_3$ (206), $LG_4$ (208) may e.g. emit different color components or they may each include LED components emitting e.g. red, green and blue light. The LED component units $LG_1$ (202), $LG_2$ (204), $LG_3$ (206), $LG_4$ (208) are preferably placed on such a surface SF (212) of the light part LU (210) that has e.g. curved or angular shape as shown in FIG. 2*a* so that the surface SF (212) consists of one or more planes as illustrated in FIG. 2*b* and 2*c*.

The angle α (200) between central rays $L_1$ (214), $L_4$ (220) of the light beams emitted by the outermost LED component units $LG_1$ (202), $LG_4$ (208) will be e.g. about 6 degrees, if intersection of the said rays is arranged to be at a distance of 60 cm from their starting points and if these points, i.e. in practice the outermost LED component units $LG_1$ (202), $LG_4$ (208), are arranged at a distance of 7 cm from each other. FIG. 2*b* shows collimators (CO) (222) of LED component units $LG_1$ (202), $LG_2$ (204), $LG_3$ (206), $LG_4$ (208) which have been arranged to delimit the light beams produced by the component units in such a way that angle a formed by the central rays L1 (214), L4 (220) of the light beams emitted by the outermost LED component units LG1 (202), LG4 (208) is of desired magnitude, preferably at least 5 degrees.

According to a preferred embodiment of the invention, the LED operation light comprises at least two power sources PW (224, 226), at least one of which is an adjustable power source ADJ-PW (226). Different LED components emitting a given color component can be connected functionally in parallel and electrically in series, allowing components emitting a given wavelength to be driven by the same power source. The light may comprise one adjustable power source ADJ-PW (226) for each LED color component, in which case each adjustable power source ADJ-PW (226) may be arranged to supply power to a LED component of predetermined color in each LED component unit $LG_1$ (202), $LG_2$ (204), $LG_3$ (206), $LG_4$ (208). If the light comprises LED components producing N different color components, it is preferably provided with means for adjusting emission of LED components which produce N or N−1 different color components. By arranging an adjustable power source for each of the LED components it is possible to maintain a constant total luminosity when the color temperature is changed—or correspondingly, also the total luminosity may be freely adjusted without changing the color temperature. It is possible to use as a power source PW (224, 226) e.g. a current source comprising a voltage limiter. In this case, threshold voltages of the LED components will have no effect on the light emission even when they warm up. One of the power sources may be a constant-current source. According to a preferred embodiment, the power sources PW (224, 226) are integrated directly with each component producing a different color of e.g. an RGB LED component, but they may also be placed elsewhere while still being functionally connected to the LED operation light.

According to the invention, the LED operation light additionally comprises measuring means MM (228) for measuring color temperature, or at least one magnitude generated by the LED components (LED) with a known correlation to the color temperature that is produced. The measuring means MM (228) may comprise e.g. one or more measuring sensors, such as an RGB color sensor, which has been arranged to produce measurement data, such as a measurement signal, representing the light emission. The measuring means MM (228) may be arranged to measure e.g. intensity of each color component produced, temperature of a LED component, color temperature of the light reflecting back from the area being operated on, or some other character of the light emission or one effecting production of it. For example, an RGB color sensor may be placed in the LED operation light such that it will detect light reflecting back from the area being operated on. A sensor of this or corresponding type may also be integrated e.g. with the reflector structure of a LED component, in which case the light emission can be measured directly from the reflector. The measuring means MM (228) are preferably integrated with the light in some way or other, but they may also be placed elsewhere.

Based on measurement data, such as a measurement signal received from the measuring means MM (228), the control means (230), such as a microprocessor or logic circuit comprised in the LED operation light and preferably integrated with the light part (210), may be arranged to generate control information, such as a control signal, to the adjustable power source ADJ-PW (226). By utilizing the control information it is possible e.g. to reduce the amount of power supplied to LED components of a given color in order to adjust the color temperature. The arrangement also allows brightness of the light produced by the LED operation light to be adjusted without substantially changing the color temperature of the light produced by the LED operation light when any non-linear correlations of the emissions of LED components of different colors to changes in the supply power may be compensated by the arrangement according to the invention by independently controlling the components producing different color components.

Figure 3:
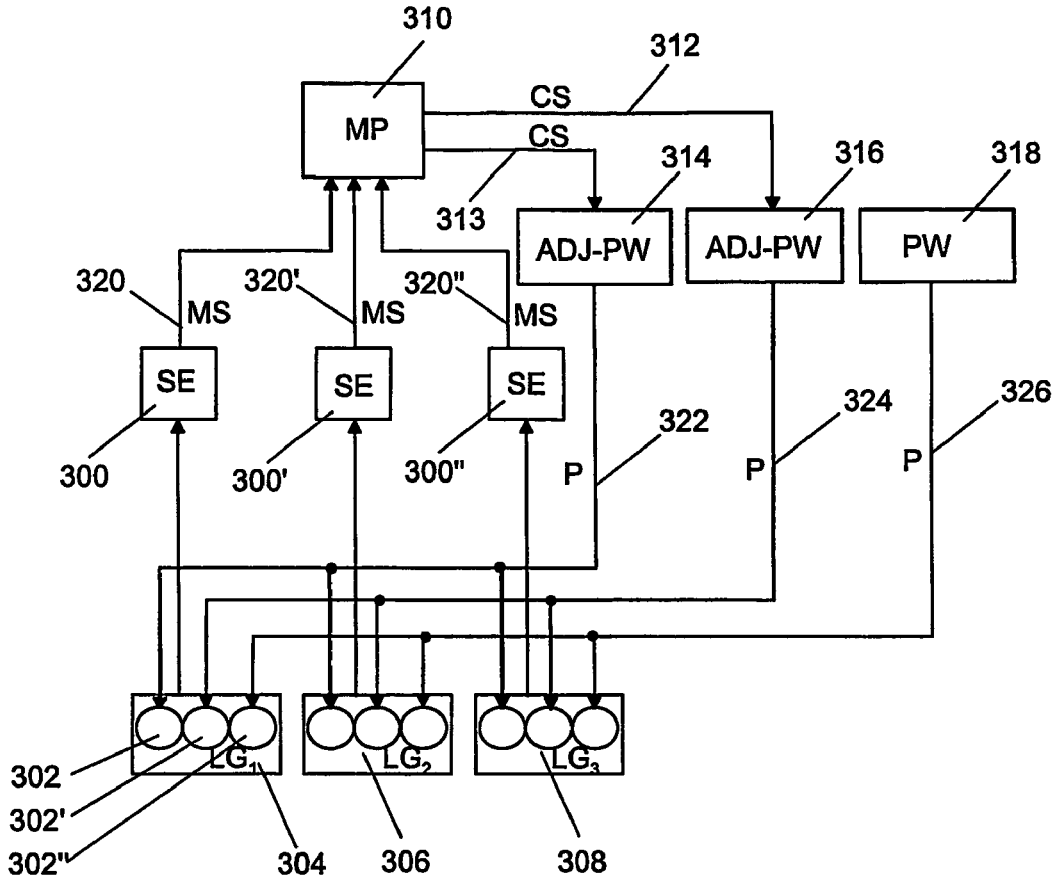
FIG. 3 presents a color temperature control system of a LED operation light according to a preferred embodiment of the invention.

FIG. 3 presents a simplified arrangement according to a preferred embodiment for adjusting the color temperature of a LED operation light. The electronics comprised in the LED operation light is fairly simple and therefore inexpensive. The measuring sensors SE (300, 300', 300") have been arranged to measure e.g. periodically e.g. the intensities of the color components produced by the LED component units $LG_1$ (304), $LG_2$ (306), $LG_3$ (308) comprising LED components (302, 302', 302") of different colors. A microprocessor MP (310) functionally connected to the measuring sensors SE (300, 300', 300") has been arranged to generate control signals CS (312, 313) for two adjustable power sources ADJ-PW (314), ADJ-PW (316), which are functionally connected to the microprocessor MP (310), in response to the measurement signals MS (320, 320', 320") received from the measuring sensors SE (300, 300', 300"). In this embodiment, one of the power sources PW (318) is a constant power source. Controlled by the control signals CS (312, 313), the power P (322, 324) supplied to the LED components (302, 302') of the LED component units $LG_1$ (304), $LG_2$ (306), $LG_3$ (308) producing two different color components is adjusted as the need arises. By adjusting the power it is thus possible to exert an influence on light emission of LED components (302, 302') of different colors and therefore on the intensity of the different wavelengths emitted, in other words, on the color temperature of the light produced by the light. On the other hand, for instance upon aging of the LED components (302, 302', 302") the power required by them to produce the same intensity as before increases. Yet according to the invention it is possible to use a separate power source e.g. for each group consisting of LED components (302, 302', 302") of different colors, or even for each individual component, in order to control brightness of the light produced by the light and/or to keep it at a desired level in such a way that the color temperature still remains substantially constant. Using the solution according to the invention new functionalities can also be created for the LED operation light, when by dimming or turning off LED components of given colors it is possible e.g. to observe changes of mucous membrane or hinder premature hardening of teeth filling composites.

According to a preferred embodiment of the invention, the LED operation light comprises a maximum of five, preferably three LED component units. The construction of the LED operation light is preferably designed to be cost effective so that the desired quantity of light is implemented with as small a number of LED component units as possible. It is possible to realize the control and measurement functionalities of the LED operation light more easily when the construction is simple. In principle it would even be possible to use only two LED component units of sufficient power, especially if the component units were implemented using a structure other than units of only one LED component. Such a structure could be an RGB LED component according to a preferred embodiment of the invention, to be described in more detail below, arranged in the form of a row. However, as a point-shaped form of the light source is an undesirable property of an operation light, there may be practical grounds for using at least three LED component units to ensure also a sufficient luminous efficiency.

Figure 4:
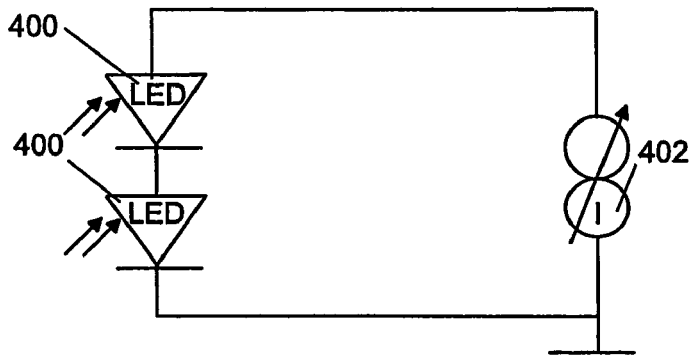
FIG. 4 presents an electric connection of LED components according to a preferred embodiment of the invention.

FIG. 4 presents two LED components LED (400) of the same color connected electrically in series, wherein an adjustable power source I (402) has been arranged to supply power to the LED components LED (400) placed e.g. in two separate RGB LED components.

Figure 5:
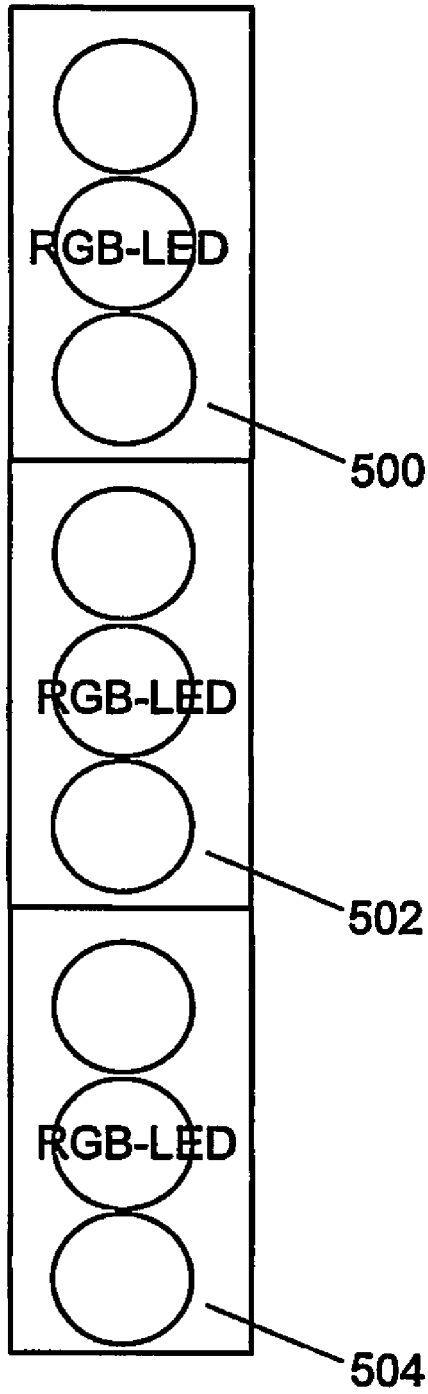
FIG. 5 presents LED component units according to a preferred embodiment of the invention.

FIG. 5 presents a LED component unit according to a preferred embodiment of the invention, comprising three RGB LED components (500, 502, 504) arranged in a row.

Figure 6:
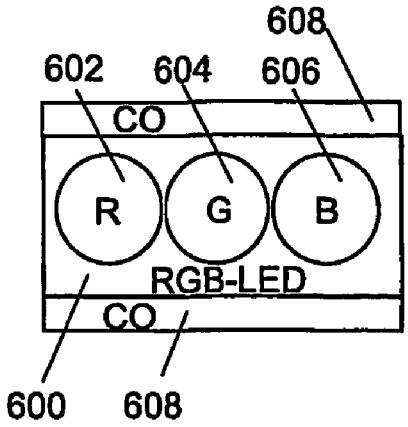
FIG. 6 presents a LED component unit according to a preferred embodiment of the invention.

According to the invention, as illustrated in FIG. 6, an RGB LED component unit (600) comprising a red R (602), a green G (604) and a blue B (606) LED component may be arranged such that the LED components (602, 604, 606) themselves form a row, too. When a RGB LED component unit like this is placed in the operation light according to the invention, it is preferably additionally provided with a collimator CO (608) aligned with the row to achieve a beam of desired form and being aimed at desired direction. The red R (602), green G (604) and blue B (606) LED components and the units consisting of them may naturally also be arranged in other forms than rows, but the structure described above is well applicable for use expressly in connection with dental care operations, considering that the typically desired shape of the light beam to illuminate the target area is elliptical in geometry.

A preferable LED component applicable for use in a LED operation light according to the invention is Luxeon® 5 W developed, manufactured and marketed by Lumileds Lighting, LLC, having a good efficiency. The Luxeon® 5 W can produce a luminous flux of even 50 times as high as one produced by many other solid-state light sources. The essential features of the construction of these components producing substantially greater luminous flux per watt include a sapphire substrate material and a reflector structure by virtue of which, as compared with prior-art devices, a smaller proportion of the energy produced is integrated into the component itself, while a larger proportion of the photons produced in the LED component may be lead at desired direction. Also, attention has been paid to the thermal design of these components so that the waste heat generated can be effectively conducted away from the component, thus allowing high energy densities to be used without risk of overheating. By using this type of components, the light can be implemented as a small and light structure.

Figure 7:
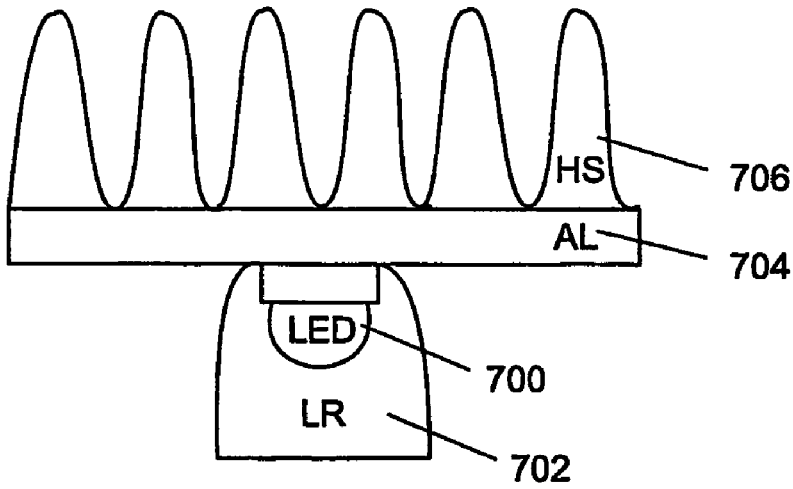
FIG. 7 presents a LED component according to a preferred embodiment of the invention.

FIG. 7 illustrates a preferable structure of a LED component applicable for use in the invention, which may be e.g. a RGB LED component as described above. As shown in FIG. 7, the LED component (700) is provided with a a lens-reflector component LR (702) for effectively collecting and directing light to the target. Thanks to the lens-reflector LR (702), the LED operation light itself need not be provided with a separate reflector, which would be expensive and difficult to construct. The LED components LED (700) are preferably attached to heat-conducting cooling HS (706) and insulating AL (704) plates. The insulating plate may be made of e.g. aluminum oxide, in which case it will be possible to provide it with integrated electric lines that can be connected e.g; to LED components. The LED components typically do not require any noisy fans as used in halogen lamps, as the cooling taking place via the cooling plate (heat sink) is sufficient. The light structure may comprise several heat sinks HS (700) or all the LED components LED (700) may share a common one, in which case the emission temperatures of the different LED components LED (700) will be substantially the same.

One of the properties of LED light sources is that each LED component material mixture has its characteristic temperature-dependent emission intensity. Therefore, e.g. in an arrangement as illustrated in FIG. 7, where all the LED components LED (700) operate at substantially the same temperature, the emission intensity of each LED component LED (700) producing different color component, and thus color temperature, of the light produced by the light can be determined relatively accurately on the basis of temperature of the heat sink HS (706). Moreover, as emission of the LED component LED (700) used to produce each color component is known as a function of temperature, the control of the color temperature of the light produced by the light can be implemented by means of the above-mentioned adjustable power sources of the LED components by measurement of temperature of the heat sink or heat sinks and use of the emission-temperature curves of the LED components.

Another way of providing the structure illustrated in FIG. 7 with the measuring means needed for controlling the LED component is to integrate means, such as an RGB color sensor measuring intensity of the emission of a color component or components produced by the LED component in the LED component itself, e.g. in its reflector, whereby the measurement signal of the sensor can be arranged to be transmitted to the microprocessor or equivalent of the light.

According to a preferred embodiment of the invention, the LED operation light comprises at least two LED components producing different shades of white, and the color temperature of the LED operation light produced by the light emissions of said components can be controlled in the same manner as described above.

The color temperature of the LED operation light can be controlled by a method according to a preferred embodiment of the invention, wherein light emission comprising color components of at least two different wavelengths is produced in response to the power supplied by at least two power sources PW, at least one which is an adjustable power source ADJ-PW, to a LED component unit LG comprising at least one LED component LED, wherein color temperature of the light produced by the LED component units (LG), or at least one magnitude generated by them and having a known correlation to the color temperature of the light produced by the LED component units (LG) is measured, and control information for at least one of the said adjustable power sources (ADJ-PW) is produced in response to measurement data obtained from said measurement to control production of at least one color component in at least one LED component (LED).

It is obvious to a skilled person that along with development of technology the basic concept of the invention may be implemented in many different ways. Thus, the invention and its embodiments are not limited to the examples and components described above; instead, they may vary within the scope of the claims below.

The invention claimed is:

1. A dental LED operation light, comprising: at least two power sources (PW), at least one which is an adjustable power source(ADJ-PW), and at least two LED component units (LG) for emitting light in response to power received from a power source (PW), which LED component units (LG) comprise at least one LED component (LED) and which LED components (LED) have been arranged to produce color components of light emission of said LED operation light at two different wavelengths at least, wherein at least two of said LED components (LED) emit light of at least two different shades of white, and wherein said LED operation light additionally comprises:

at least one measuring means (MM)

i. for measuring the color temperature of the light emission produced by said LED component units (LG), ii. for measuring light reflected from a surface, or iii. for measuring at least one magnitude generated by the LED component units (LG) that has a known correlation to the color temperature of the light emission produced by said LED component units (LG), and at least one control means (CM) for generating control information for at least one of said adjustable power sources (ADJ-PW) in response to measurement data received from said measuring means (MM) to control production of at least one color component in at least one LED component (LED) to maintain a constant or desired color temperature.

2. The dental LED operation light according to claim 1, wherein at least one of said measuring means (MM) has been arranged to measure intensities of said emitted color components.

3. The dental LED operation light according to claim 1, wherein at least one of said measuring means (MM) has been arranged to measure temperature of said LED components (LED).

4. The dental LED operation light according to claim 1,wherein said measuring means (MM) comprise at least one measuring sensor (SE), which has been arranged to output the said measurement data as a measurement signal (MS), and said control means (CM) comprise at least one processor (MP) or logic circuit, which has been arranged to produce said control information as a control signal (CS).

5. The dental LED operation light according to claim 1,wherein said LED component unit (LG) comprises a red (R), a green (G) and a blue (B)LED component.

6. The dental LED operation light according to claim 5, wherein the light comprises at least two LED component units (LG), which units comprise a red (R), a green (G) and a blue (B) LED component (LED) arranged in a row, said LED component units (LG) being arranged to form a row aligned with said LED component row.

7. The dental LED operation light according to claim 1, further comprising at least one adjustable power source (ADJ-PW) for each LED component color to be emitted, each adjustable power source (ADJ-PW) being arranged to supply power to LED components (LED) emitting a given color component.

8. The dental LED operation light according to claim 7, wherein said adjustable power sources (ADJ-PW) are integrated with the LED components (LED).

9. The dental LED operation light according to claim 1,wherein said LED component (LED) is a high power LED component whose average input power exceeds 500 mW.

10. The dental LED operation light according to claim 1,wherein one of said power sources (PW) is a constant-current source.

11. The dental LED operation light according to claim 6,wherein the light comprises a collimator arrangement (CO) functionally connected to it and aligned with the row formed by said LED component units (LG).

12. The dental LED operation light according to claim 11, wherein said collimator arrangement (CO) comprises collimators (CO) provided in said LED component units (LG).

13. The dental LED operation light according to claim 1,wherein the angle (a) between the central rays of the light beams emitted by the outermost LED component units (LG) is at least 5degrees.

14. The dental LED operation light according to claim 1,wherein the aforesaid at least two LED component units (LG) comprise LED components (LED) comprising a lens-reflector component LR (702), the aforesaid measuring means (MM), , being integated integrated with the said lens-reflector LR (702) to measure the color component or components emitted from the LED component (LED) in question.

15. The dental LED operation light according to claim 1,further comprising:

LED components (LED) producing N different color components, N being an integer equal to or higher than two, and adjustable power sources (ADJ-PW) arranged for at least N-l LED components (LED) producing different color components.

16. The dental LED operation light according to claim 15, further comprising:

N pieces adjustable power sources (ADJ-PW).

17. A method for controlling the color temperature of a dental LED operation light, in which method:

light emission comprising color components of at least two different wavelengths is produced in response to the power supplied by at least two power sources (PW), at least one of which is an adjustable power source (ADJ-PW), to at least two LED component units (LG),which emit light of at least two different shades of white, and which LED component units comprise at least one LED component (LED), comprising the steps of:

providing measurement of i. the color temperature of light produced by the LED component units (LG), ii. light being reflected from a surface, or iii. at least one magnitude generated by LED component units (LG) and having a known correlation to the color temperature of the light produced by the LED component units (LG), and producing control information for at least one of said adjustable power sources (ADJ-PW) in response to measurement data obtained from said measurement to control the production of at least one color component in at least one LED component (LED) to maintain a constant or desired color component.

18. The method according to claim 16, wherein intensity of each emitted color component is measured by measuring intensities of emissions of LED components producing red, green and blue color components by means of an RGB color sensor.

19. The method according to claim 17, wherein temperature of the LED components (LED), especially temperature of a heats ink arranged to be shared by said components is measured, and production of color components is controlled in a desired manner on the basis of characteristic temperature-emission correlation of each of the LED components used.

20. The method according to claim 17, wherein emission of at least one of said color components is controlled by means of at least one adjustable power source by connecting at least some of the LED components (LED) producing the color component in question electrically in series, and this series to at least one of said adjustable power sources, so that the production of that color component of light changes in response to the adjustment of said at least one power source.

21. The method according to claim 17, wherein

LED components producing N different color components are used, N being an integer equal to or higher than two, and the production of at least N- 1 color components is controlled.

22. The method according to claim 21, wherein the production of N color components is controlled.

* * * * *